US005601457A

United States Patent [19]

Le Gall

[11] Patent Number: 5,601,457

[45] Date of Patent: Feb. 11, 1997

[54] FEMALE ELECTRICAL CONTACT OF THE SOCKET TYPE

[75] Inventor: Jean-François Le Gall, Saint-Cloud, France

[73] Assignee: Framatome Connectors International, Courbevoie, France

[21] Appl. No.: 327,672

[22] Filed: Oct. 21, 1994

[30] Foreign Application Priority Data

Oct. 22, 1993 [FR] France ..... 93 12637

[51] Int. Cl.[6] ..... H01R 13/187

[52] U.S. Cl. ..... 439/843

[58] Field of Search ..... 439/842, 843, 439/851–856, 861, 862

[56] References Cited

U.S. PATENT DOCUMENTS

| | | | |
|---|---|---|---|
| 3,323,101 | 5/1967 | Eickmier | 439/843 |
| 4,534,603 | 8/1985 | Brown et al. . | |
| 4,753,616 | 6/1988 | Molitor | 439/843 |

FOREIGN PATENT DOCUMENTS

| | | |
|---|---|---|
| 213312 | 6/1986 | European Pat. Off. . |
| 569369 | 9/1973 | Germany . |

OTHER PUBLICATIONS

Search Report FR 93 12637.

*Primary Examiner*—David L. Pirlot
*Attorney, Agent, or Firm*—Pollock, Vande, Sande & Priddy

[57] ABSTRACT

A female electrical contact of the socket type comprising a tubular body (1) defining a housing (3) provided with a front inlet orifice (4) for receiving a male electrical contact of the pin type, and a plurality of elastically deformable contact springs (5) which are centrally curved radially inwards and which extend substantially longitudinally, being distributed in a cylinder to constitute a cage. The springs are secured to the body by one of their ends, and are fixed to the body adjacent to their front ends, and the front ends of the springs are connected to one another by a front ring (9) which fits over the outline of the housing (3) in the vicinity of its inlet orifice (4) and is secured thereto.

5 Claims, 1 Drawing Sheet

FEMALE ELECTRICAL CONTACT OF THE SOCKET TYPE

FIELD OF THE INVENTION

The present invention relates to improvements to a female electrical contact of the socket type comprising a tubular body defining a housing provided with a front inlet orifice for receiving a male electrical contact of the pin type, and a plurality of elastically deformable contact springs which are centrally curved radially inwards and which extend substantially longitudinally, being distributed in a cylinder to constitute a cage, the springs being secured to the body by one of their ends.

PRIOR ART

U.S. Pat. No. 4,572,606 discloses a female contact structure of the socket type including a tubular body enclosing a plurality of springs distributed along the inside periphery of the body and kept radially inwardly curved in their central zones. The springs are secured to the body at their rear ends and thus constitute a contact element that is virtually in the form of a cage, while the front ends of the springs are free to move longitudinally.

DE 35 31 845 describes a female contact structure of the socket type in which a plurality of contact springs constitute a one-piece cage that is held captive but is free to slide inside the tubular body of the contact and is retained axially with clearance by two abutments. While the associated male contact is being inserted, the cage is pushed back against the rear abutment and is stopped thereby, and the axial clearance then leaves room for the cage to expand axially in the forward direction.

The drawback presented by these prior art female contacts is that, because the springs are secured to the tubular body at their rear ends, when they bear against the associated male contact they are free to expand longitudinally in the forward direction only, i.e., in the direction opposite to that in which the male contact is inserted.

If a mishap should occur during the relative movement of coupling (e.g., because the pin is wrongly inserted, or because a foreign body is interposed between the spring and the pin of the male contact), one or more springs may be subjected to a large, rearwardly-directed force, and since they cannot expand properly in the forward direction, they run the risk of being subjected to irreversible longitudinal deformation (kinking), thereby damaging the female contact.

In addition, specifically because expansion takes place in the direction opposite to the displacement of the male contact, the insertion force is not constant and it retains a value which is excessive and uncontrollable.

Finally, with a cage that has a floating mount, as in the contact of DE 35 31 845, there is an additional drawback of it being impossible to control accurately the position of the cage during insertion of the male contact. The cage is initially pushed back and compressed against the rear abutment; only thereafter the axial expansion of the cage takes place in a forward direction, which makes it even more risky or even impossible to maintain an insertion force that is constant and small throughout coupling.

U.S. Pat. No. 3,120,989 discloses a female contact structure of the socket type in which a curved contact spring associated with a tubular body is secured by its front end to the body in the vicinity of the inlet orifice thereof, while its rear end remains free to move longitudinally. Nevertheless, in that known contact, there is only one deformable spring and the contact thus suffers from the drawbacks inherent in that type of structure (small number of zones of contact with the male contact, small contact area, asymmetry of the forces bearing against the male contact, . . . ). In addition, the means for retaining the spring in the socket require machining (rings associated with the spring, groove formed in the socket) that is expensive in terms of both time and money and that is unsuitable for low cost manufacture.

SUMMARY OF THE INVENTION

An essential object of the invention is to remedy the various drawbacks described above by a socket type female electrical contact structure which better satisfies various practical requirements, in particular with respect to obtaining an insertion force that is as constant and as small as possible.

To this end, the invention provides a contact of the socket type in which the springs are fixed to the body adjacent to their front ends, and in which the front ends of the springs are connected to one another by a front ring which fits over the outline of the housing in the vicinity of its inlet orifice and is secured thereto.

Because of this structure, the cage constituted by the contact spring expands in the same direction as the insertion direction of the associated male contact. As a result, it is certain that under normal circumstances no disturbing force will alter the resilient force with which each spring bears against the male contact all along the insertion stroke thereof. Under such conditions, the insertion force is kept as constant and as small as possible throughout insertion of the male contact in the female contact, and the multiplicity of springs arranged as a cage ensures that contact forces are radially symmetrical and that both the number of contact zones and the area of contact are appropriate for optimum electrical conduction. In the event of a mishap, an additional force component generated by increased friction between a spring and the male contact will continue in the direction that coincides with the insertion direction of the male contact and, even though the insertion force is increased, it cannot damage the spring and spoil the female contact.

In a preferred embodiment of the invention, the rear ends of the springs are also connected to one another by means of a rear ring whose transverse size is smaller than that of the housing and which is free to move longitudinally inside the housing, and it is the respective central zones of the springs which are curved radially inwards.

In both of the above embodiments, it is advantageous for the springs and the front ring, together with the rear ring (if any) to be unitary, in particular a part obtained by cutting out a metal sheet and then rolling it up. Such a part is simple and cheap to manufacture.

In any of the preceding embodiments, it is most advantageous for the front ring to be secured to the tubular body by crimping to the inlet orifice thereof. In an advantageous embodiment, the inlet orifice of the tubular body has a flare that is open towards the outside, the front ring has a flare that is open towards the front and that is complementary in shape to the flare of the tubular body so as to bear thereagainst, and the front edge of the inlet orifice is folded over to extend radially in front of the front edge of the front ring and thus retain the ring. This permits simple assembly which can be performed with ordinary tooling.

BRIEF DESCRIPTION OF THE DRAWINGS

The invention will be better understood on reading the following detailed description of several embodiments given by way of example, with reference to the accompanying description, reference is made to the accompanying drawings, in which.

DETAILED DESCRIPTION

Figure 1:
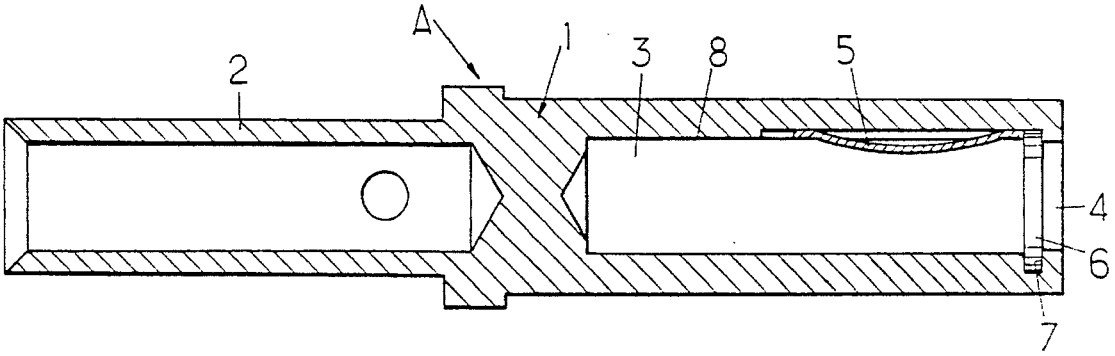
FIG. 1 is a schematic side view, in section, of a female contact of the socket type with a single contact spring disposed in accordance with the prior art.

FIG. 1 shows a female contact structure known from U.S. Pat No. 3,120,989, in which a female electrical contact A of the socket type comprises a body 1 provided at its rear end with a member 2 or tail suitable for connection to an electrical circuit, in particular an electric wire (not shown), e.g., by soldering.

The front portion of the body 1 is hollow to define a housing 3 which is open at its front end via an inlet orifice 4 and which is shaped and sized to receive a pin type male electrical contact (not shown). In the example shown, the housing 3 is circularly symmetrical.

An elastically deformable contact spring 5 that extends substantially longitudinally and laterally is disposed inside the housing 3. The front end of the spring is secured to a ring 6 having a bore whose diameter is no smaller than that of the associated male contact. Ring 6 is received and held coaxially in an annular groove 7 formed in the inside face of the body 1 behind and close to its inlet orifice. Behind its front end, the spring 5 curves longitudinally, its convex side being directed radially towards the central axis of the housing 3. The rear end 8 of the spring 5 is free, and when a male contact (not shown) is inserted or withdrawn, it can move longitudinally as a function of the radial deformation imparted by the male contact to the convex portion of the spring.

In a female contact of that structure, the single elastically deformable spring exerts a contact force on one side only of the male contact during insertion, and the radial asymmetry of this force does not facilitate in any way reducing the insertion force to as small a value as possible. Furthermore, the small contact area between the single spring and the male contact does not favor obtaining good quality electrical continuity.

Figure 2:
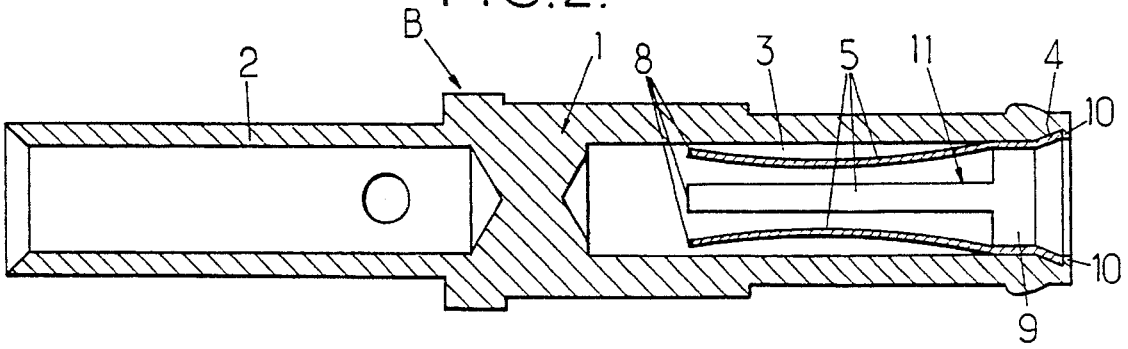
FIG. 2 is a schematic side view, in section, of a female contact having a plurality of contact springs forming a cage and disposed in accordance with the invention.

FIG. 2 shows a female contact B in accordance with the invention, having a plurality of deformable springs 5 which are disposed in a cylinder and whose front ends are united by a front ring 9, the assembly formed in this way virtually constituting a cage. In this structure, the annular edge of the body which defines the inlet orifice 4 flares towards the outside and the front ring 9 is also flared at least in part towards the front, which is complementary to that of the orifice 4 in the body. This disposition facilitates installing the springs in the body 1 because the ring 9 which fits closely over the axial and circumferential outline of the orifice 4 of the housing overlies the flared portion thereof and presses thereagainst. A peripheral projection 10 that extends axially and that surrounds the orifice 4 is folded over the free edge of the ring 9 and covers it (crimping). The ring 9 is thus held axially between the flared portion of the body and the folded-over edge of the inlet orifice.

The springs 5 are thus individually free to expand longitudinally.

In practice, the springs 5 and the ring 9 constitute a single part 11 obtained by cutting out and rolling up metal sheet or foil.

Figure 3:
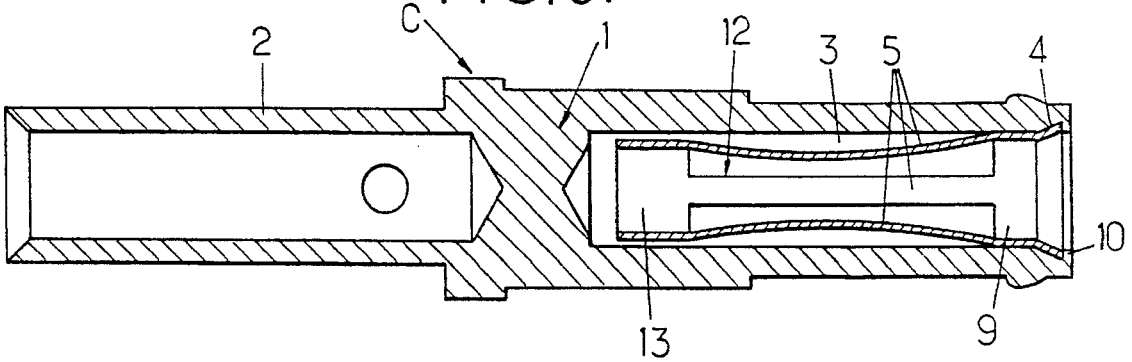
FIG. 3 is a schematic side view, in section, of a preferred embodiment of the female contact of FIG. 2.

FIG. 3 shows a preferred embodiment comprising a female contact C having a contact member in the form of a cage 12. The cage 12 is made in the same manner as the part 11 in the contact B of FIG. 2 except in that the rear ends of the springs 5 are also interconnected by means of a rear ring 13. The ring can have any desired shape and its transverse size is such as to allow it to slide freely in the longitudinal direction inside the housing 3. Constituted in this way, the cage 12 can be subjected to free longitudinal expansion in the insertion direction of the male contact. The cage 12 may be manufactured by a cutting-out and rolling-up operation. It constitutes a part that is mechanically strong and whose configuration serves firstly to obtain an insertion force that is as constant and as small as possible while the male contact is being inserted, and secondly to obtain symmetrical contact over a large contact area with the male contact, thus giving rise to good electrical continuity.

I claim:

1. A female electrical contact of the socket type comprising a tubular body defining a housing having a front inlet orifice for receiving a male electrical contact of the pin type, and a plurality of elastically deformable contact springs which are curved radially inward and which extend substantially longitudinally, said contact springs being distributed in a cylinder to constitute a cage, said contact springs being fixed to said tubular body adjacent to front ends of said contact springs, and said front ends of said contact springs being connected to one another by a front ring which fits over an outline of said housing in a vicinity of said inlet orifice and is secured to said housing, wherein rear ends of said contact springs are also connected to one another by means of a rear ring, said rear ring having a transverse size smaller than a transverse size of said housing and being free to move longitudinally inside said housing, and wherein respective central zones of said contact springs are curved radially inwards.

2. An electrical contact according to claim 1, wherein said contact springs and said front ring constitute a single part obtained by cutting out and rolling up sheet metal.

3. An electrical contact according to claim 1, wherein said contact springs, said front ring and said rear ring constitute a single part obtained by cutting out and rolling up sheet metal.

4. An electrical contract according to claim 1, wherein said front ring is secured to said tubular body by crimping said front ring to said inlet orifice.

5. An electrical contact according to claim 4, wherein said inlet orifice has a flare opening outwardly, said front ring has a flare opening towards the front and complementary in shape to said flare of said inlet orifice of that tubular body so as to bear thereagainst, and a front edge of said inlet orifice is folded over to extend radially in front of a front edge of said front ring and thus retain the front ring.

* * * * *